United States Patent [19]

Fujimoto

[11] Patent Number: 4,521,380

[45] Date of Patent: Jun. 4, 1985

[54] APPARATUS FOR DILUTION OF PULP

[76] Inventor: Shigeo Fujimoto, 3984-24 Imaizumi, Fuji-shi, Shizuoka-ken, Japan

[21] Appl. No.: 489,411

[22] Filed: Apr. 26, 1983

[30] Foreign Application Priority Data

May 7, 1982 [JP] Japan ..... 57-75494

[51] Int. Cl.[3] ..... B01F 7/20; B01F 15/04; D21C 7/12; G05D 7/06

[52] U.S. Cl. ..... 422/273; 162/57; 162/238; 162/262; 162/263; 366/169; 366/196; 366/251; 366/279; 422/111; 422/269

[58] Field of Search ..... 422/111, 116, 269, 273, 422/292; 162/57, 254, 261–263, 49, 238, 258; 366/169, 294, 196, 245, 249, 251, 279

[56] References Cited

U.S. PATENT DOCUMENTS

| | | | |
|---|---|---|---|
| 323,456 | 8/1885 | Simonton | 422/269 |
| 1,181,973 | 5/1916 | Tyson | 422/269 X |
| 1,268,592 | 6/1918 | McLaughin et al. | 366/332 |
| 1,307,329 | 6/1919 | Trent | 422/269 |
| 2,322,720 | 6/1943 | Scott et al. | 366/194 X |
| 2,348,123 | 5/1944 | Green et al. | 366/169 X |
| 2,627,978 | 2/1953 | Curtis | 422/269 X |
| 2,663,553 | 12/1953 | Booth | 422/269 |
| 3,438,743 | 4/1969 | Grunewald et al. | 422/111 |
| 3,682,444 | 8/1972 | Reinhalt | 162/254 X |
| 3,929,416 | 12/1975 | Tanaka et al. | 422/225 X |
| 3,992,248 | 11/1976 | Hunter | 162/17 |
| 4,158,597 | 6/1979 | Petterson | 162/238 |
| 4,190,490 | 2/1980 | Tomlinson | 162/57 X |
| 4,305,907 | 12/1981 | Baird | 422/116 X |

FOREIGN PATENT DOCUMENTS

| | | | |
|---|---|---|---|
| 699304 | 12/1964 | Canada | 366/169 |

*Primary Examiner*—Barry S. Richman
*Assistant Examiner*—Brion P. Heaney
*Attorney, Agent, or Firm*—Wenderoth, Lind & Ponack

[57] ABSTRACT

A pulp diluting apparatus has a cylindrical vessel having the top portion thereof covered with a lid having a pulp inlet, a bearing mounted on the center of the lid, a lower steady support bearing mounted on the center of a bottom end portion of the cylindrical vessel, a rotary shaft held between the top bearing and the lower steady support bearing and provided on the lower portion thereof with rods having scraper plates, a water supply pipe disposed on the bottom end portion of the cylindrical vessel for supplying water into the cylindrical vessel, a valve provided on the water supply pipe for controlling the amount of water to be supplied into the water supply pipe, a driving machine connected to the rotary shaft for rotating the rotary shaft, a torque detector for detecting the torque of the driving machine and controlling the valve of the water supply pipe, and an outlet provided in the lower portion of the cylindrical vessel for taking the diluted pulp out of the cylindrical vessel.

17 Claims, 3 Drawing Figures

APPARATUS FOR DILUTION OF PULP

BACKGROUND OF THE INVENTION

1. Field of the Invention

The present invention relates to a novel apparatus for the dilution of pulp.

2. Description of the Prior Art

Recently, it has been desired to store pulp in a state of as high pulp density as possible and to continuously take out the pulp while diluting the same so that it has a given low density. This desire is based on the fact that the dilution of pulp stored at high density is easier and more rapid than the dilution of pulp into slurry of given density by use of a large quantity of water, that the supervision of the diluting of the pulp to the desired density is esier in the former type of dilution than in the latter type of dilution, that the energy consumption is considerably smaller in the former than in the latter, and that it is possible to miniaturize the diluting apparatus for the former type of dilution. However, since the higher the pulp density, the more difficult the handling of the pulp as a fluid, the former dilution is disadvantageous in that it becomes difficult to continuously take out the pulp directly from a reservoir having high-density pulp stored therein. The storage of pulp at high density and the continuity in dilution of pulp require antipodal conditions. For this reason, there has heretofore been suggested a diluting apparatus which has a reservoir containing high-density pulp provided with a stirrer and is adapted to dilute the pulp by jetting diluting water from the stirrer and allowing the swollen high-density pulp to fall. However, this diluting apparatus has a disadvantage in that there occurs an adverse phenomenon that stirring cannot be effected because the high-density pulp is swollen into a mass and becomes heavy. In view of this disadvantage, it has been proposed to provide the diluting apparatus with a special device for taking out the slurry and to pour a large quantity of water toward the vicinity of a pulp outlet. However, this procedure has fatal disadvantages that since the fall of the pulp onto a dilution portion is unstable which makes the variation in density large, it is impossible to take out pulp of given density and the energy consumption for the dilution cannot be reduced.

SUMMARY OF THE INVENTION

In consideration of the various disadvantages described above, the present inventors have conducted studies and consequently arrived at the present invention.

An object of the present invention is to provide an apparatus capable of storing pulp in a state of high density, continuously diluting the pulp to a given lower density and continuously taking the diluted pulp out of the apparatus.

To attain the object described above, according to the present invention, there is provided an apparatus for the dilution of pulp, which comprises a cylindrical vessel having the top portion thereof covered with a lid having a pulp inlet, a top bearing mounted on the center of the lid, a lower steady support bearing mounted on the center of the bottom end portion of the cylindrical vessel, a rotary shaft held between the top bearing and the steady support bearing and provided on the lower portion thereof with rods having scraper plates thereon, a water supply pipe disposed on the bottom end portion of the cylindrical vessel for supplying water into the cylindrical vessel, a valve provided on the water supply pipe for controlling the amount of water to be supplied into the water supply pipe, a driving machine connected to the rotary shaft for rotating the rotary shaft, a torque detector for detecting the torque of the driving machine and controlling the valve of the water supply pipe, and an outlet provided in the lower portion of the cylindrical vessel for taking the diluted pulp out of the cylindrical vessel.

The aforementioned and other objects and characteristic features of the present invention will become apparent from the description to be given hereinafter in detail with reference to the accompanying drawings.

DETAILED DESCRIPTION OF THE PREFERRED EMBODIMENT

Now, the present invention will be described in detail with reference to the accompanying drawings.

Figure 1:
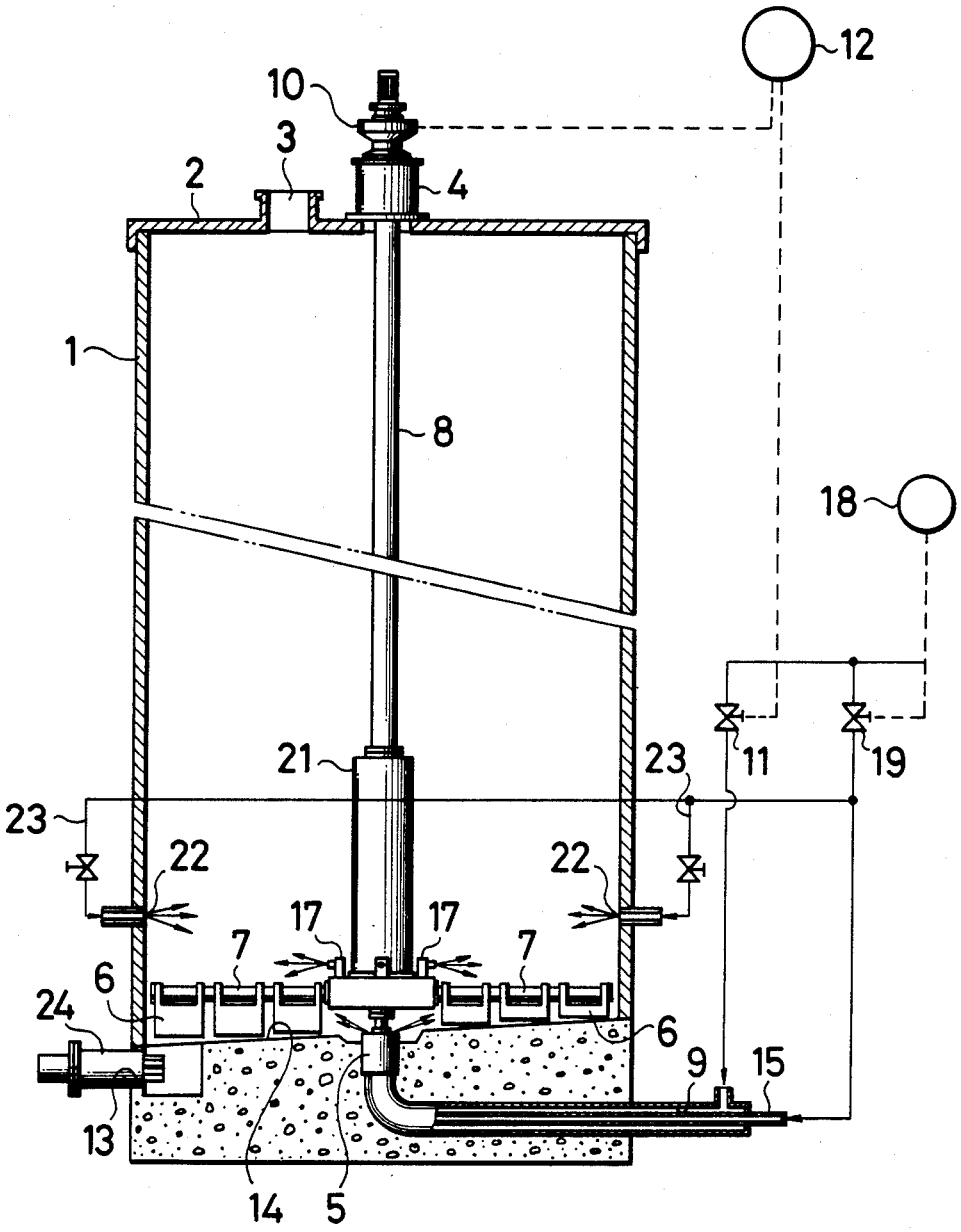
FIG. 1 is a longitudinal cross section illustrating one embodiment of the apparatus for the diluting of pulp according to the present invention.
Figure 2:
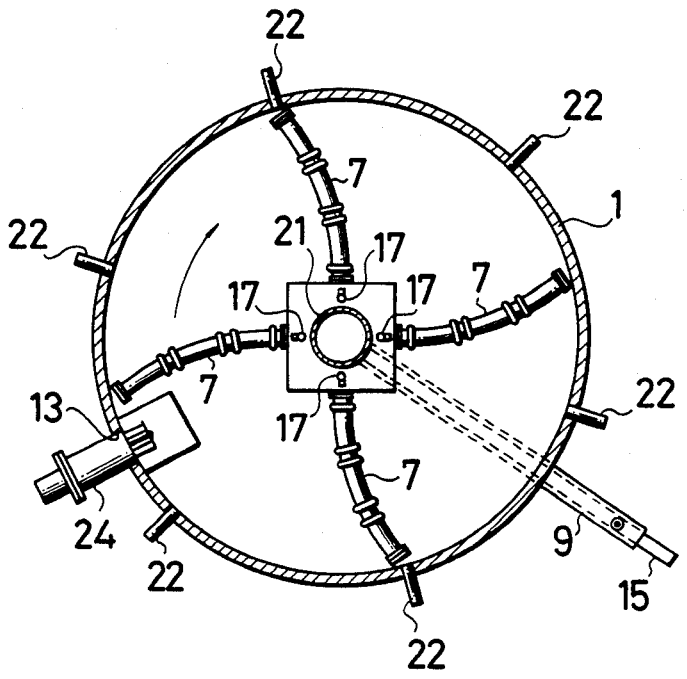
FIG. 2 is a lateral cross section of the embodiment of FIG. 1.

FIG. 1 is a cross section showing the apparatus for the dilution of pulp according to the present invention. Denoted by 1 is a cylindrical pulp diluting vessel covered with a lid 2 having a pulp inlet 3. A rotary shaft 8 extending from above the central upper portion of the vessel toward the bottom of the vessel is held between a top bearing 4 mounted on the lid and a lower steady support bearing 5 to thereby prevent runout of the rotary shaft. Around the lower portion of the rotary shaft, a plurality of rods 7 are arranged and provided with scraper plates 6 thereon. Although each rod may be straight, it is preferably bent to have a convex portion extending in the rotating direction, as seen in FIG. 2, so that rotation may be made smoothly. The scraper plates may be fixed firmly to the rods and, when swingably connected to the rods, advantageously fulfill their function because resistance adjustment can automatically be effected. A water supply pipe 9 is connected to the lower portion of the vessel for delivering water for dilution into the vessel and it is desirable to have its opening disposed at the center of the lower portion of the vessel so as to uniformly supply water. Since water is supplied from the lower portion of the vessel, as described above, a current of water ascends and serves to push pulp upwardly. The vessel is provided on the lower portion thereof with an outlet 13 for diluted pulp slurry. A stirrer 24 is attached to the slurry outlet for taking the pulp slurry out of the vessel. The bottom end portion 14 of the vessel is inclined downwardly toward the slurry outlet, thereby enhancing the effect of taking the pulp slurry out of the vessel. The scraper plates cause the diluted pulp to collect toward the slurry outlet. A driving machine 10 for the rotary shaft 8 is provided with a torque detector 12 for detecting the torque of the driving machine and controlling the opening and shutting of a valve 11 of the water supply pipe in response to the detected torque to adjust the amount of water for dilution.

The apparatus for the dilution of pulp according to the present invention is constructed as described above. Therefore, pulp is urged to ascend by the water supplied from the lower portion of the vessel and, therefore, floats within the vessel. Dilution of a mass of swollen pulp begins from the contact portion between the lower portion of the pulp and water and is effected continuously. For these reasons, no weight is exerted on the rotary shaft. In other words, the load exerted on the rotary shaft varies in accordance with only the concentration of the pulp in the pulp slurry. According to the present invention, therefore, since the pulp concentration in the pulp slurry can be found by detecting the torque of the rotary shaft, control of the amount of water to be supplied from the lower portion of the vessel enables the pulp slurry having uniform concentration to be taken out of the vessel.

Figure 3:
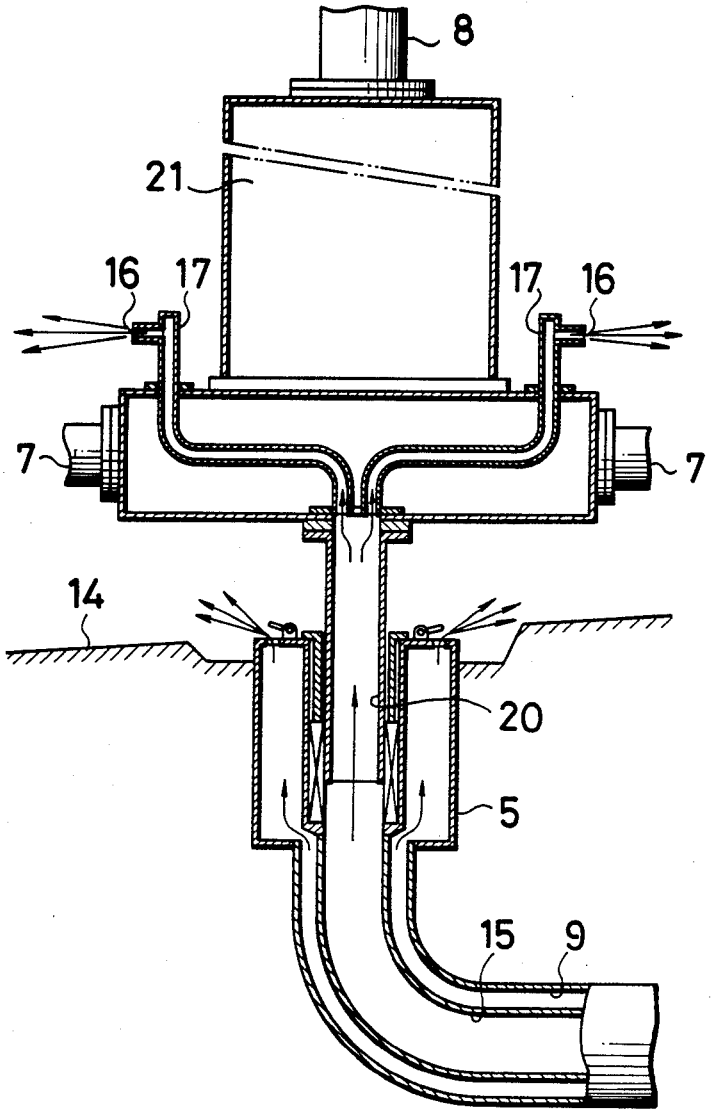
FIG. 3 is a partially enlarged, longitudinal cross section of the bottom end portion of the embodiment of FIG. 1.

As shown in FIGS. 1 and 3, the pulp diluting apparatus of the present invention is provided around the rotary shaft thereof with water dischargers 17 each having a water outlet 16 which opens radialy into the interior of the vessel and with a water supply tube 15 which is connected to the water dischargers. Water is jetted from the water dischargers against the pulp in accordance with the concentration of the pulp to be taken out of the vessel to facilitate the dilution of the pulp. The water outlets open in the vicinity of the surface of contact between the water and the mass of swollen pulp which floats by means of the water supplied upwardly from the lower portion of the vessel and are diluted from the contact surface. When the concentration of the pulp is decreased, water is supplied to the bottom surface of the diluted pulp mass to facilitate the dilution of the pulp mass. When the dilution reaches an equilibrium state, a timer 18 is set to allow water to be periodically discharged, thereby maintaining a constant pulp concentration. In order to smoothly dilute the pulp and obtain good results, it is necessary to uniformly discharge water into the vessel and to arrange the water dischargers around the rotary shaft. The water supply tube 15 for feeding water to the water dischargers is, as shown in FIGS. 1 and 3, positioned within the water supply pipe 9 for supplying water into the vessel, thereby making the apparatus as a whole compact. Further, a passage 20 is formed in the steady rest bearing. Water is supplied through the passage into the water dischargers which are arranged around the rotary shaft and, therefore, the water supply tube is not exposed to the interior of the vessel and the interior space of the vessel to be put to practical use can be increased.

A float chamber 21 is disposed, as illustrated in FIGS. 1 and 3, on the rotary shaft at a position above the rods and serves to make the rotary shaft buoyant to reduce the load exerted on the bearings and decrease the energy required for the driving of the rotary shaft and, at the same time, to prevent the mass of pulp from falling from the position of the float chamber. The mass of swollen pulp is pushed up by water and floats within the vessel. However, there is a possibility of the mass falling. The fall of undiluted pulp adversely affects not only the taking-out of the diluted pulp but also the concentration, etc. of the diluted pulp. However, since the pulp is swollen into a mass, it is caught by the float chamber which protrudes from the surface of the rotary shaft, thereby enabling the mass of pulp to be prevented from falling. Since the float chamber is buoyant even when it catches the mass of pulp and since the mass of pulp is pushed up by water, there is little effect on the load. The float chamber is made of a buoyant material to serve as a float and has the interior thereof hollow and preferably filled with a gas such as air, etc. sealed therein as shown in FIG. 3. The float chamber may be disposed concentrically around the rotary shaft. In place of the float chamber, a plurality of hollow pipes may be disposed around the rotary shaft. By positioning the aforementioned water dischargers around the float chamber, water is spurted from the water dischargers toward the surface of contact between the diluting water and the mass of pulp caught by the float chamber, with the result that the dilution of pulp can considerably be facilitated.

Water distribution pipes 23 each having a water outlet 22 which opens to the interior of the vessel are attached to the side wall of the vessel at positions above the rods and above the position at which the pulp is diluted. The water fed from the water distribution pipes 23 is absorbed by the pulp to effectively swell the pulp which helps to dilute the pulp. The amount of water spurted from the water distribution pipes may be controlled in advance by the timer 18, similarly to the case of the water dischargers 17, in accordance with the amount of pulp to be thrown into the vessel, the amount of slurry to be taken out of the vessel, the slurry concentration, etc.

A method for using the apparatus for the dilution of pulp according to this invention will be described. The pulp introduced from the pulp inlet 3 into the vessel, as illustrated in FIG. 1, floats in the water and absorbs the water so as to be swollen. The water distributed from the water distribution pipes 23 aids in swelling the pulp. In proportion as the swelling of pulp proceeds, the amount of water absorbed by capillarity by the pulp is decreased and the mass of pulp descends. However, the mass of pulp is pushed up by the water supplied from the lower portion of the vessel and caught by the float chamber 21 in the floating state. The dilution of the pulp begins from the surface of contact between the pulp mass and the water. The slurry into which the mass of pulp is diluted is scraped and collected by the scraper plates 6 of the rods 7 and discharged out of the vessel through the slurry outlet. When the slurry concentration is low, water is spurted from the water dischargers 17 to facilitate the dilution of the pulp, whereas when the slurry concentration is high, the increased torque of the driving machine 10 is detected and the amount of the water supplied from the water supply pipe 9 is increased in proportion to the increase in torque. The amount of the water both from the water dischargers and from the water supply pipe is adjusted by detecting the torque of the rotary shaft and effecting the opening and shutting of the valves 11 and 19. In the stationary state of the rods, these valves may be operated by the timer 18.

A working example wherein the apparatus shown in FIG. 1 has been used will be described hereinafter. The volume of the vessel was 423.9 $m^3$ and the yield of pulp per day was 100 tons. The power required for the driving machine 10, the stirrer 24 and a pump for the diluting water was respectively 2.2 KW, 2.2 KW and 11 KW. The total power was therefore 15.4 KW. In a conventional method, the total power required was 44 KW because two stirrers having power of 15 KW were required although a diluting water pump having power of 11 KW was used. According to the present invention, therefore, 65% of the conventionally used power could be saved in comparison with the conventional apparatus. In view of the fact that the solid content of the pulp stored in the conventional apparatus was 18% at most, the present apparatus is much superior because it can store therein pulp with a solid content of 25%. This means that the present apparatus can be utilized 30% more effectively, when calculated in terms of the volume of the vessel, than the conventional apparatus. In the case where high-concentration pulp is thermally treated, the apparatus of the present invention is superior in consumption of heat energy. To be specific, when one ton of pulp having a solid content of 18% in the conventional apparatus was heated so that the increase in temperature was 10° C., 48,555 Kcal of of heat energy was required. On the other hand, when one ton of pulp having a solid content of 25% was treated in the present apparatus, the required heat energy was 33,000 Kcal. 15,555 Kcal of heat energy which corresponds to 1.414 l per ton of the pulp when calculated in terms of fuel oil carbon could therefore be saved according to the present invention.

As described above, the present invention substantially solves adverse problems which have heretofore remained outstanding in the conventionally known apparatuses and, therefore, the invention provides a substantial contribution to the field.

What is claimed is:

1. In a pulp diluting apparatus having a cylindrical vessel, a lid having a pulp inlet therein covering the top of said vessel, a bottom end portion of said cylindrical vessel, an upper bearing mounted on the center of said lid, a lower steady support bearing mounted on the center of said bottom end portion of said cylindrical vessel, a rotary shaft rotatably mounted between said upper bearing and said lower bearing, rods having scraper blades mounted on the lower portion of said rotary shaft, a driving machine connected to said rotary shaft for rotating said shaft, and an outlet in the lower part of said cylindrical vessel beneath said rods for taking the diluted pulp out of said cylindrical vessel, the improvement comprising:

water dischargers mounted on said rotary shaft in the center of said cylindrical vessel at a position above said rods and in positions spaced circumferentially around said rotary shaft and each having a water outlet disposed at a level above said rods and opening radially into the interior of said cylindrical vessel, and a first water supply pipe connected to said water dischargers;

a second water supply pipe disposed at the bottom portion of said cylindrical vessel proximate the center of said bottom end portion and opening generally upwardly into fluid communication with the interior of said cylindrical vessel at a position below said rods, means for supplying water to said second water supply pipe at a pressure at least sufficient for causing said second water supply pipe to discharge an ascending current of water sufficiently strong for pushing a mass of pulp contained within said cylindrical vessel upwardly;

a valve provided in said second water supply pipe;

a torque detector connected with said driving machine for detecting the torque of said driving machine and connected to said valve for operating said valve in response to an increase in torque detected to control the pressure of water supplied to said cylindrical vessel through said second water supply pipe to discharge an ascending current of water capable of pushing the lower portion of the mass of pulp upwardly at least to the position of said water outlets of said water dischargers.

2. The apparatus according to claim 1 wherein the improvement further comprises outlet for the diluted pulp being provided in the bottom end portion of said cylindrical vessel and being in contact with the side wall of said cylindrical vessel.

3. The apparatus according to claim 1 wherein the improvement further comprises scraper plates being swingably attached to said rods.

4. The apparatus according to claim 1 wherein the improvement further comprises said bottom end portion of said cylindrical vessel being inclined downwardly toward said outlet.

5. The apparatus according to claim 1 wherein the improvement further comprises a stirrer attached to said outlet.

6. The apparatus according to claim 1 wherein the improvement further comprises a second valve connected in said first water supply pipe and a timer connected to said second valve for controlling said second valve.

7. The apparatus according to claim 1 wherein the improvement further comprises said first water supply pipe being accommodated in said second water supply pipe.

8. The apparatus according to claim 1 wherein the improvement further comprises said lower steady support bearing having a passage therein and said first water supply pipe being connected to said water dischargers through said passage.

9. The apparatus according to claim 1 wherein the improvement further comprises water distribution pipes, each having a water outlet in the side wall of said cylindrical vessel, opening into the interior of said cylindrical vessel at a position above said rods.

10. The apparatus according to claim 9 wherein the improvement further comprises a second valve connected to said water distribution pipes and a timer connected to said second valve for controlling said second valve.

11. The apparatus according to claim 9 wherein the improvement further comprises said first water supply pipe being accommodated in said second water supply pipe.

12. The apparatus according to claim 9 wherein the improvement further comprises said lower steady support bearing having a pasage therein and said first water supply pipe being connected to said water dischargers through said passage.

13. The apparatus according to claim 1 wherein the improvement further comprises a float chamber on the lower portion of said rotary shaft and above said rods.

14. The apparatus according to claim 13 wherein the improvement further comprises said water dischargers being vertical dischargers disposed outside said float chamber and said water outlets projecting laterally therefrom into the interior of said cylindrical vessel.

15. The apparatus according to claim 14 wherein the improvement further comprises a second valve attached to said first water supply pipe and a timer connected to said second valve for controlling said second valve.

16. The apparatus according to claim 14 wherein the improvement further comprises said first water supply pipe being accommodated in said second water supply pipe.

17. The apparatus according to claim 14 wherein the improvement further comprises said lower steady bearing support having a passage therein and first water supply pipe being connected to said water dischargers through said passage.

* * * * *